US009957683B2

(12) United States Patent
Dawson

(10) Patent No.: US 9,957,683 B2
(45) Date of Patent: May 1, 2018

(54) SHEET PILING

(71) Applicant: DAWSON CONSTRUCTION PLANT LIMITED, Buckinghamshire (GB)

(72) Inventor: Robin Dawson, Buckinghamshire (GB)

(73) Assignee: DAWSON CONSTRUCTION PLANT LIMITED, Buckinghamshire (GB)

( * ) Notice: Subject to any disclaimer, the term of this patent is extended or adjusted under 35 U.S.C. 154(b) by 0 days. days.

(21) Appl. No.: 15/038,995

(22) PCT Filed: Nov. 25, 2014

(86) PCT No.: PCT/GB2014/053478
§ 371 (c)(1),
(2) Date: May 24, 2016

(87) PCT Pub. No.: WO2015/075480
PCT Pub. Date: May 28, 2015

(65) Prior Publication Data

US 2017/0002536 A1 Jan. 5, 2017

(30) Foreign Application Priority Data

Nov. 25, 2013 (GB) ..... 1320760.0

(51) Int. Cl.

| | |
|---|---|
| ***E02D 5/20*** | (2006.01) |
| ***E02D 5/04*** | (2006.01) |
| ***E02D 5/08*** | (2006.01) |
| ***E02D 5/28*** | (2006.01) |

(52) U.S. Cl.
CPC ..... *E02D 5/20* (2013.01); *E02D 5/04* (2013.01); *E02D 5/08* (2013.01); *E02D 5/28* (2013.01)

(58) Field of Classification Search
CPC .... E02D 5/02; E02D 5/03; E02D 5/04; E02D 5/08; E02D 5/14; E02D 5/16; E02D 5/20; E02D 5/28
USPC ..... 405/274, 276, 277, 278, 279, 280, 281
See application file for complete search history.

(56) References Cited

U.S. PATENT DOCUMENTS 1,831,426 A * 11/1931 Schroeder ..... E02D 5/76 405/279
2008/0145153 A1* 6/2008 Wendt ..... E02B 3/108 405/274

FOREIGN PATENT DOCUMENTS

| | | |
|---|---|---|
| GB | 143.453 | 5/1920 |
| WO | WO 99/42669 | 8/1999 |
| WO | WO 00/28156 A1 | 5/2000 |

* cited by examiner

*Primary Examiner* — Carib A Oquendo
(74) *Attorney, Agent, or Firm* — Womble Bond Dickinson (US) LLP

(57) ABSTRACT

A method of forming a sheet pile wall comprising cold reforming a Z-shape pile or a U-shape pile and connecting a plurality of reformed steel piles so as to form a sheet pile wall having at least one engagement section, the engagement section when viewed in a cross section being a recess that has a narrowed neck portion.

18 Claims, 15 Drawing Sheets

SHEET PILING

FIELD OF THE INVENTION

The present invention concerns sheet piling, for example as used in civil engineering and large construction projects.

BACKGROUND OF THE INVENTION

Sheet piles are used in civil engineering to support vertical loads and/or to resist lateral pressures. The piles are sunk or driven into the ground. Sheet piles are formed from individual piles, generally formed of steel, which are interlocked or otherwise joined together to form a "wall".

Uses for a sheet pile wall include use as a retaining wall, for example, to hold back water or earth. Walls constructed using sheet piling are used as both temporary and permanent structures and will generally be substantially water tight. A common use of a sheet pile retaining wall would be as a cofferdam, for example, in construction of a below water-level structure or a below ground structure. Another example would be as part of a bridge pier in a river.

Traditionally individual piles have each been formed in either a generally "U-shape" or a generally "Z-shape" with the web of the "Z" approximately 120° to 135° to the flanges. It will thus be appreciated that when the piles are joined together, with each alternate pile facing the opposite direction, they form a sheet pile having a cross section which approximates a square wave. The steel piles are generally formed by hot rolling, in a steel mill, but may also be cold formed. The depth of the pile is determined by the depth of grooves in the rolls, in the steel rolling mill. For the depth of the pile to become greater, then the depth of the grooves in the rolls must be increased. The traditional width of a pile was 600 mm to 700 mm.

As will be appreciated, the rigidity of the sheet pile is a critical parameter. The conventional indicator of rigidity is the section modulus of the steel pile or sheet pile. To increase the section modulus, it is desirable to increase the depth of the pile, but because of the limit to the depth of the grooves in the forming rolls of the steel mill it becomes more difficult to roll piles with a deep profile. In practice there is a maximum depth of approximately 500 mm that can be rolled, without the grooves in the rolls being so deep that they tend to weaken the rolls to the point where they can break.

Solutions to the requirement for a high modulus have been sought. Current solutions include using "Z-shape" or "U-shape" profiles in combination with "H-shape" profiles or tubular profiles to create a wall. As will be appreciated, these walls can take a variety of forms, depending on the arrangement of the piles and the requirements of the wall. To achieve the highest modulus, the tubular or "H-shape" profiles will generally be oriented such that the webs of the profiles are substantially at 90° to the plane of the front of the wall. This provides the highest level of stability and strength. However, the depth of a wall is an increasingly important factor in the construction of sheet piling walls and walls having tubular or "H-shape" profiles will inevitably add substantial depth to the wall due to the orientation of the piles. The depth of the wall is particularly important in situations where space is limited, for example when forming coffer dams for city basements. Here a greater depth of pile is a significant penalty to owners of buildings due to the consequence of a loss of useable space. Accordingly, a compromise will often have to be made between the depth of a wall and the strength.

An alternative solution to the requirement for a high rigidity is the strengthening of the sheet piles of a wall through the use of plates, which are welded to the sheet piles. These plates can be added to the traditional "Z-shape" or "U-shape" steel piles, or to the solutions involving "H-shape" or tubular profiles. However, the additional welding and materials that are required will increase costs and labour requirements. Furthermore, the weight of the pile will be substantially increased. Similar issues also arise when constructing "H-shape" or tubular piles. For completeness, it should be mentioned that another factor is the thickness of the steel, both at the flanges and webs and at the extreme edges. Obviously, greater stiffness can be achieved by using a thicker steel section, but this is undesirable since it leads to a heavier and more expensive section. In the above discussion, a steel section of standard thickness is being assumed (generally 20 mm).

A method for manufacturing sheet piling is taught in WO-A-99/42669. The method teaches that an "open Z-shape" piling or an "open U-shape" piling manufactured by hot forming steel sections can be cold reformed to decrease the angle between the flanges and the web so as to increase the depth of the section and increase its section modulus, while still maintaining at least some of the advantage of the width of an "open Z-shape" or an "open U-shape".

Where a sheet pile wall is used as a retaining wall, for example against a flow of water, the wall may be strengthened or optimised using additional materials and/or components. For example, in a river, the wall requires a smooth face for hydraulic flow and a slender section to minimise impedance to the flow of water and resistance to abrasion and corrosion. This is typically achieved through casting concrete in situ. Where a high modulus retaining wall is required in marine applications, the sheet piles are often connected to large steel pipes having diameters of approximately 1 m to 2 m. These retaining walls are known as "Combi" walls. However, these walls cannot be concrete clad due to their shape. Thus, they often suffer from abrasion and corrosion, resulting in significant maintenance costs.

SUMMARY OF THE INVENTION

The invention provides a method and apparatus as defined in the independent claims.

In one aspect, a method of forming a sheet pile wall is provided, the method comprising reforming a Z-shape pile or a U-shape pile and connecting a plurality of reformed steel piles so as to form a sheet pile wall having at least one engagement section. The engagement section, when viewed in a cross section, is a recess having a narrowed neck portion.

The Z-shape pile comprises two flanges and a web, the angle between the web and the flanges being greater than 90° and reforming the pile can comprise decreasing the angle to less than 90°. The U-shape comprises two webs and a flange, the angle between the webs and the flange being greater than 90° and reforming the pile can comprise decreasing the angle to less than 90°.

The engagement section is a section whose shape enables the engagement of other components to the sheet piling. In other words, the engagement section enables the use of a tongue and groove coupling, with the engagement section forming the "groove" portion of the coupling. An example of an engagement section would be a dove-tail shape. Sheet piles having this profile offer a number of advantages, as discussed in more detail below.

In an embodiment, the reforming step comprises cold-reforming the pile. By cold reforming, it is meant that the steel pile is reformed at ambient temperature; however it will be appreciated that this may involve the application of heat, for example in low temperature environments to prevent cracking.

In an embodiment, the Z-shape pile is cold reformed so as to decrease the angle between each of the flanges and the web to less than 90°. In another embodiment, the U-shape is cold reformed so as to decrease the angle between each of the webs and the flange to less than 90°.

The invention in this embodiment thus provides a method that "closes" a "Z-shape" or a "U-shape" pile (in some embodiments, a hot-formed "Z-shape" or "U-shape" pile) from an arrangement whereby the angle between the web and the flange of the pile is an obtuse angle to an arrangement whereby the angle between the web and the flange of the pile is an acute angle. The invention provides the surprising advantage of increasing the section modulus of a wall formed using a plurality of reformed piles, without a substantial increase in the depth of the pile, and delivering a shape to the pile which immediately enables sheet piles of a "fish-tail", "tongue-and-groove" or "dovetail" profile to be produced.

The idea of substantially reducing the width of a pile, and making the web/flange angle less than 90°, goes completely against the industry standard of having piles of an open shape in order to reduce the number of piles and the amount of work required to construct a sheet pile.

In a second aspect, a method of forming a sheet pile wall is provided, the method comprising reforming a Z-shape pile or a U-shape pile and connecting a plurality of reformed steel piles so as to form a sheet pile wall having at least one engagement section. The engagement section, when viewed in a cross section, is a recess having a narrowed neck portion.

The Z-shape pile comprises two flanges and a web; and reforming the pile can comprise reforming the pile such that at least a portion of the web extends away from a linear vector extending between the first end and second end of the web. The U-shape pile comprises two webs and a flange and reforming the pile can comprise reforming the pile such that at least a portion of the flange extends away from a linear vector extending between the first end and second end of the flange.

By "linear vector extending between the first end and the second end of the web" it is meant that if an imaginary straight line were drawn from one end of the web (e.g. the point at which the web joins the flange in a Z-shape pile) to the other end of the web (e.g. where the web joins the other flange in a Z-shape pile), then at least part of the web does not follow this line (i.e. is it bent away from this line).

In other words, the steel pile (steel section) is subsequently cold reformed such that the web of the pile is no longer straight. This forms an engagement section having a width wider than that of a forward portion of the enclosure formed by the pile (by forward it is meant towards the opening of the enclosure). For example, if the webs of a U-shape pile are bent inwardly (i.e. towards one another), the opening of the enclosure may remain wider than the point at which the webs are bent inwardly. By enclosure it is meant the area partially enclosed and defined by the flange(s)/web(s) of a pair of reformed Z-shape pile or a single reformed U-shape pile.

In an embodiment of the method of the first or second aspects, reforming the Z-shape pile or the U-shape pile comprises cold reforming the pile.

In an embodiment, the invention in the first or second aspect provides a method of forming a composite wall comprising additional components such as in-situ concrete and steel cages without the need for any additional mechanical connections. For example, the in-situ concrete can be on one or both sides of the wall.

In another embodiment, the invention in the first or second aspect provides a method of forming a composite wall comprised of two lines of steel sheet piles, with a hollow formed therebetween. The hollow may be reinforced with concrete and a steel cage. In this embodiment, the lines of steel piling may be spaced apart depending on the required properties of the wall. This wall may optionally have an additional outer concrete face on one or both of the steel piling lines.

In another embodiment, the invention in the first or second aspect provides a method of forming a wall to which additional components (for example, a tie rod or a floating fender) can be attached using a dove-tail shaped anchor or any anchor that securably engages with the engagement sections of the wall without the need for cutting, welding or bolting. In another embodiment shuttering may be fixed to the base of the sheet pile in order to retain additional components or concrete in the engagement section (e.g. when the pile is immersed in water).

DETAILED DESCRIPTION

A method of forming a sheet pile wall is provided, the method comprising reforming a Z-shape pile or a U-shape pile. Once reformed, a plurality of the reformed steel piles are joined so as to form a sheet pile wall. By virtue of the reforming of the sheet piles and the forming of a sheet pile wall, at least one recess (or engagement section) is formed. The recess or engagement section (when viewed in a cross section), has a narrowed neck portion, which may widen again towards the opening of the recess. The shape of the recess thus provides a socket or tongue-and-groove-type connector.

Figure 1A:
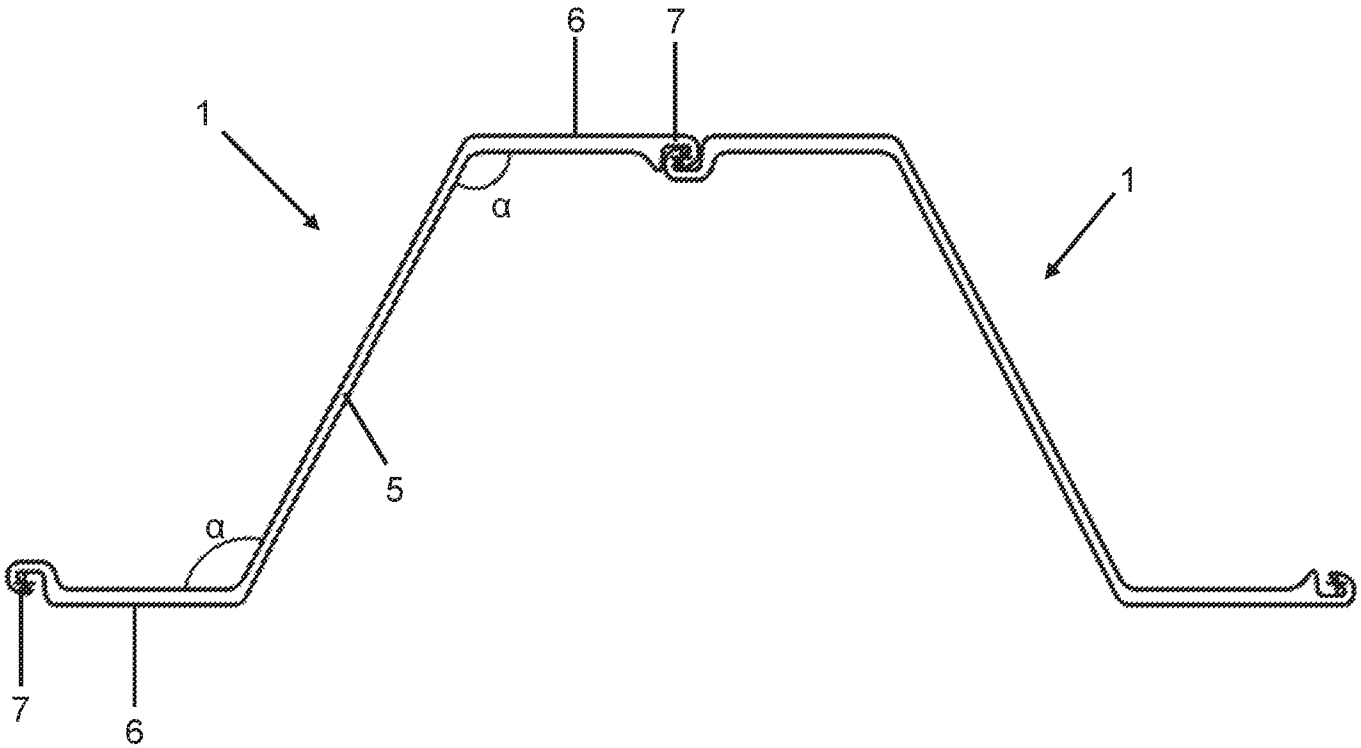
FIG. 1*a* shows, in a cross section, a double pile of two Z-shaped piles prior to reforming.
Figure 1B:
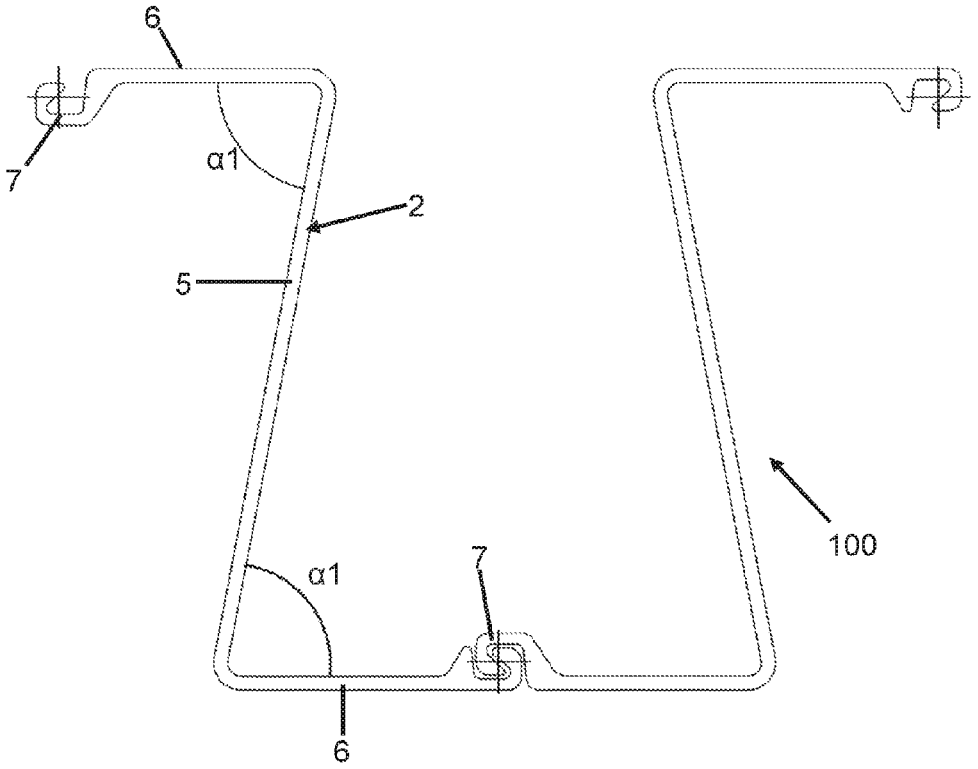
FIG. 1*b* shows, in a cross section, reformed Z-shaped piles according to an embodiment of the present invention.

FIG. 1*a* shows two interlocked, hot-formed Z-shape steel piles 1. Each of the piles 1 has a web 5 and two flanges 6, each of the flanges terminating in an interlock 7. The angle α where each of the flanges 6 join the web 5 of the hot-rolled Z-shape piles 1 is an obtuse angle, typically 120° to 135°. In an embodiment of the present invention each of the Z-shape steel piles 1 is reformed so as to make at least one of the angles α acute (i.e. less than 90°). Optionally both angles would be altered so as to maintain symmetry though in some embodiments only one of the Z-shape piles may be reformed. FIG. 1*b* shows two interlocked, reformed Z-shape steel piles 2 according to the present invention. The angle α1 between each of the flanges 6 and the web 5 is now an acute angle. For example, angle α1 may be 85°, 70°, 60°, 50° or 45°.

Figure 2A:
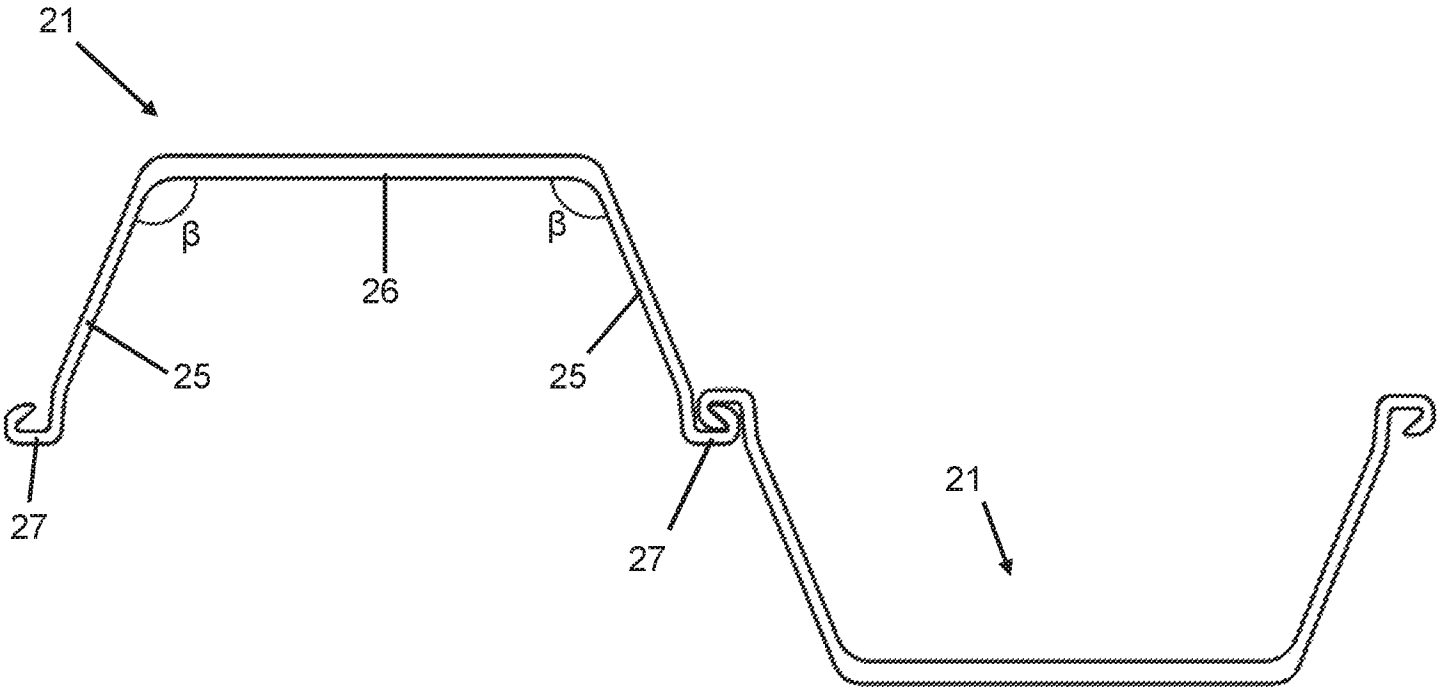
FIG. 2*a* shows, in a cross section, a double pile formed of two open U-shaped piles, prior to reforming.
Figure 2B:
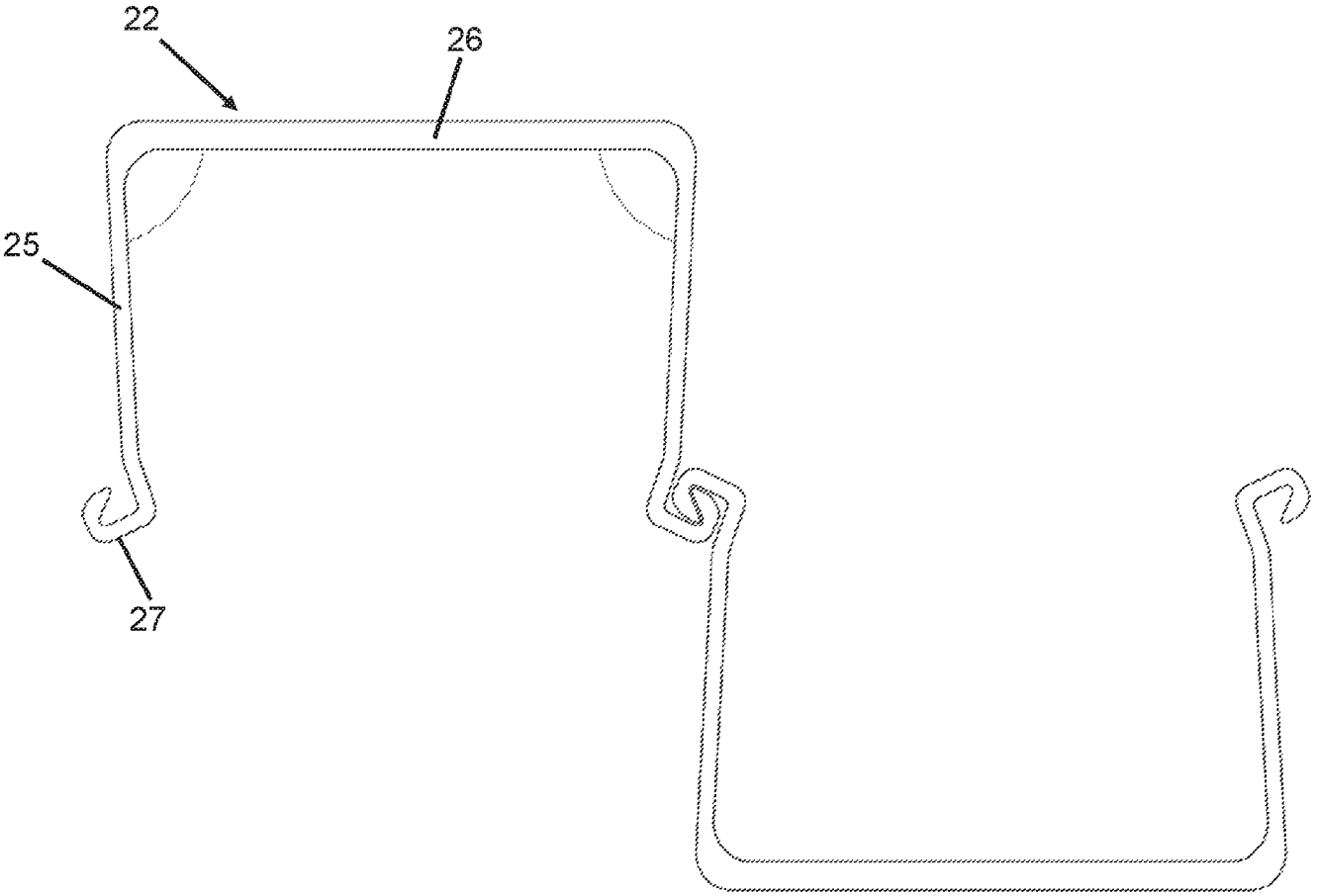
FIG. 2*b* shows, in a cross section, reformed U-shape piles according to an embodiment of the present invention.

FIG. 2*a* shows two hot-rolled U-shape steel pile 21. Each U-shape steel pile 21 has two webs 25 connected by a flange 26. The angle β, defined by the connection between each of the webs 25 and the flange 26, is an obtuse angle (i.e. greater than 90°), typically 120° to 135°. In an embodiment of the present invention the U-shape steel pile 21 is reformed so as to make at least one of the angles α acute (i.e. less than 90°). Optionally both angles would be altered so as to maintain symmetry. FIG. 2*b* shows a reformed U-shape steel pile 22 according to the present invention. The angle β1 at each of the flange/web connections is now an acute angle. For example β1 may be 85°, 70°, 60°, 50° or any other acute angle greater than 20°. In another embodiment, the pile may be reformed to form the even more acute angle, angle β2. β2 may be, for example, 45° or 30°.

With both Z-shape and U-shape piles, as the angle between the web and the flange becomes more acute, the section modulus of a single pile will increase up to the point where the included angle becomes a right angle. Once the angle is substantially less than 90°, the section modulus of a single profile will then start to reduce as the angle decreases. However, the number of piles that can be installed per meter of wall increases as the angle decreases. Accordingly, the section modulus per unit of wall increases. For example, a Z-shaped pile having a width of 700 mm when in a first arrangement, can be reduced to a width of 350 mm. This results in a two-fold increase in section modulus per meter of wall, with little or no difference in the wall thickness.

As will be seen in FIGS. 1*a-b* and 2*a-b*, at the edges of the piles there is a "hook" shape interlock mechanism 7, 27 with which each pile is intended to be interlocked with the adjacent pile. The interlocking edges of the piles are not particularly relevant to the new idea of the present invention. However, it can be noted that in the embodiment of FIGS. 2*a-b*, with the decreasing of angle α the relative angle of the web immediately adjacent the "hook" 27 is decreased also, which may orientate the hook 27 wrongly in terms of its connection with the next pile. Thus, in practice, it may be necessary to open out or "flatten" the angle between the web and the section immediately adjacent the "hook".

The reforming of a typical Z-shape pile 1 to a reformed Z-shape pile 2 results in a pile 2 that, when joined with at least one other pile 2, forms a "dove-tail" shape 50 (see FIGS. 1*b* and 9 to 11). Similarly, the reforming of a typical U-shape pile 21 to form a reformed U-shape pile 22 according to an embodiment of the invention forms a dove-tail shape 50 (see FIG. 2*b*). This dove-tail or fish-tail shape 50 facilitates the connection of the sheet piles 2, 22 to other components (such as a fender or a rubber cap), for example by enabling a tongue and groove connection. This reduces (and in many cases, eliminates) the requirement for bolting and welding and increases the scope for using pre-cast components. This reduces the costs of manufacture and construction and the time required to construct pile walls.

Figure 10:
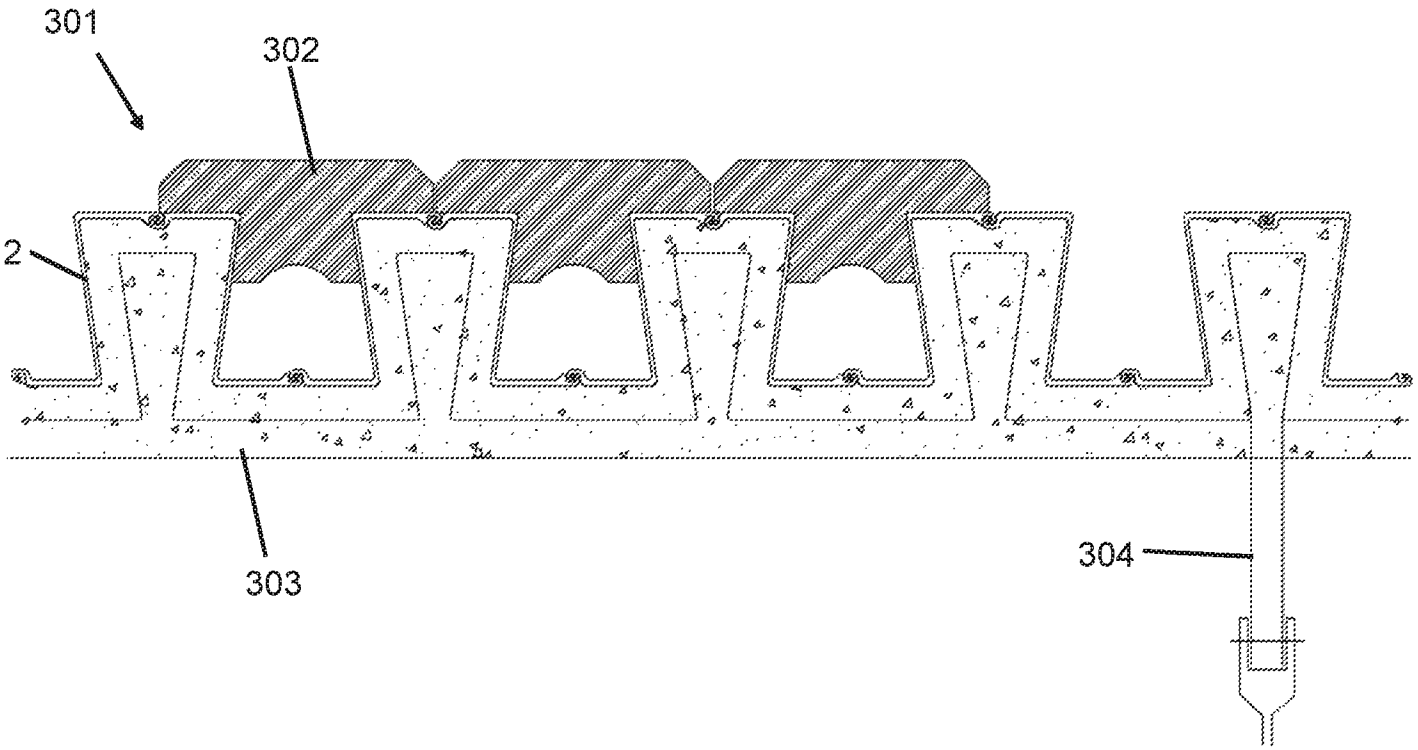

For example, as shown in FIG. 10, a rubber protecting cushion 302 can be formed to correspond to the dove-tail shape 50 thus permitting engagement in a tongue and groove fashion. Alternatively, the shape of rubber cushion 302 may not correspond to the dove-tail shape 50 but may be an alternative shape which has an engaging connection with the dove-tail shape 50. Once the wall 301 has been formed, the rubber protecting cushion 302 can be joined to the wall 301 such that a part of the rubber cushion 302 engages the dove-tail shape 50 and forms a protective layer on one face of the wall 301. In an embodiment, no further securing means are required. However, in an alternative embodiment, the rubber cushion 301 may be further secured by other means, such as by a bolt connecting the rubber cushion 302 to the wall 301 or by filling any remaining space in the dove-tail shape 50 with concrete. Alternatively, or in addition, steel or plastic fibre ropes could be formed in the rubber during manufacture. These could be cast into the concrete in the dove-tail shape 50 or secured to the piling by other means. Preferably, the void in the dove-tail shape 50 will be filled to prevent water pressure or air pressure build up behind the rubber cushion 302.

As indicated above, the invention finds application with hot-rolled piles where the angle (α) between the web and the flange is substantially greater than 90°. By this is meant 100° or more, preferably 114° or more. It can also be noted that, in practice, the angle α in hot rolled piles would not be greater than 150°.

Figure 3:
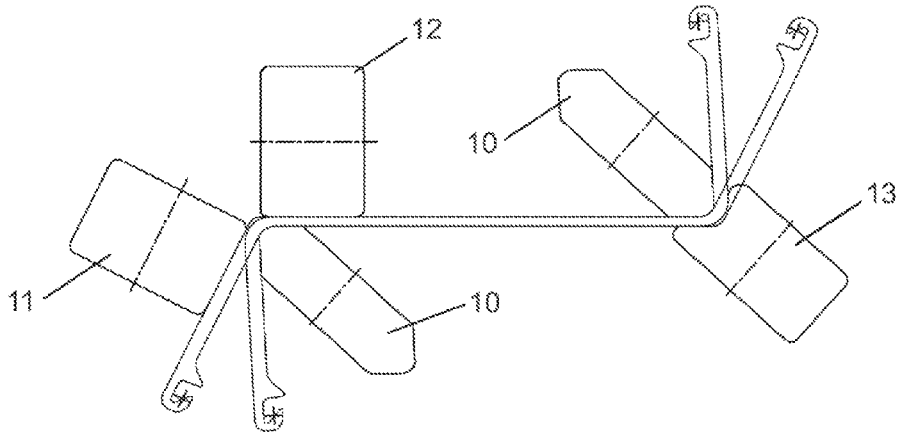
FIG. 3 shows an example of how the piles may be cold reformed, to alter the relative angles.
Figure 4:
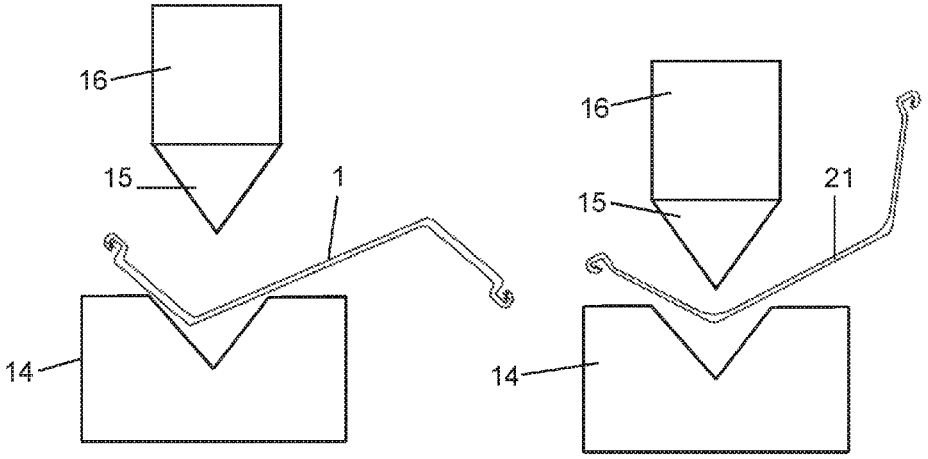
FIG. 4 shows an additional example of how the piles may be cold reformed, to alter the relative angles.

FIGS. 3 and 4 illustrate the method step for cold reforming of the hot rolled steel piles. By cold reforming, it is meant that the steel pile is reformed at ambient temperature; however it will be appreciated that this may involve the application of heat, for example in low temperature environments to prevent cracking. Steel commonly used in sheet piling is usually ductile through a 180° bend. However, in low temperature environments (for example at 0° C.) it may be necessary to pre-heat the steel to approximately 50° C. in order to avoid cracking, particularly if the steel quality is prone to brittleness. This heating is minimal and therefore still falls within the usual definition of cold-reforming.

The reforming process may be done, for example, on:

a) single piles as they pass through the usual cold straightening rolls;
b) single piles passing through an additional machine which could be rolling or by pressing; or
c) single piles or double piles may be reformed, off the rolling mill site, either at a secondary process location or at the construction site itself.

FIG. 3 shows examples of reworking rolling arrangements which can be used to decrease the angle α to angle α1 or α2. To the left hand side of FIG. 3, a ridged roller 10 is seen on the inside of the angle and a pair of rollers 11 and 12 are on the outside, the angle between the faces of rollers 11, 12 defining the desired angle α1 or α2. On the right hand side of FIG. 3, the ridged roller 10 is again seen on the inside of the angle; in this example, the angle β is defined between the inclined faces of a grooved roller 13, rather than two separate rollers being provided.

In the embodiment of FIG. 4, the cold reforming working method uses, instead of rollers, a press block arrangement. A "V" block 14 is shown, the relative angle between the faces of the "V" defining the angle $\alpha 1$ or $\alpha 2$. A ridged blade 15 of a knife press 16 is pressed into the block 14, with the angle of the pile in between, to change in the angle from $\alpha$ to $\alpha 1$ or $\alpha 2$. The same operation can of course be done at the other angle of the pile.

It will be appreciated that the change in angle $\alpha$ to $\alpha 1$ or $\alpha 2$ may in some instances be done in two or more cold reforming stages.

Figure 5A:
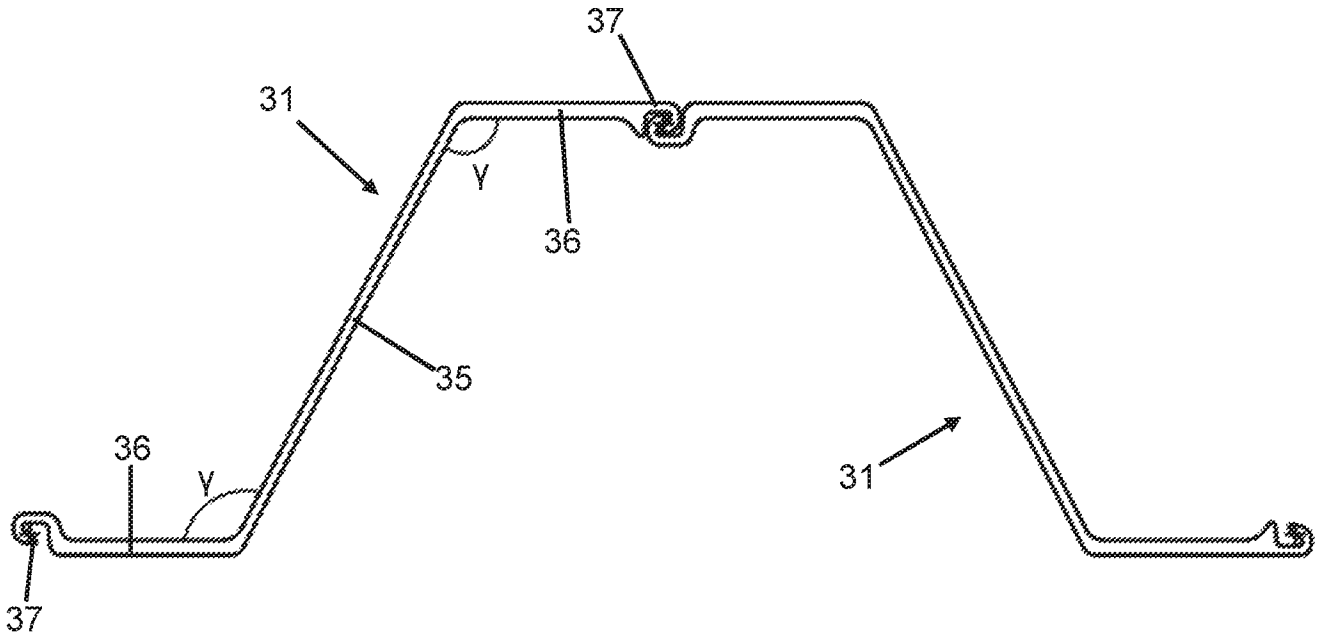
FIG. 5*a* shows, in a cross section, a double pile of two Z-shaped piles prior to reforming.

In another embodiment of the invention, two hot-formed Z-shape piles 31, each having a web 35 and two flanges 36 (see FIG. 5*a*), may be reformed (e.g. by cold reforming) so as to bend at least a portion of the web 35. The web 35 of the Z-shape piles 31 may be bent in either direction and at any point. This results in reformed Z-shape piles 32 each having a web 35 that extends away from a linear vector drawn between the two web and flange connections (indicated by the hashed line 38). The angle $\gamma$ of the web and flange joint may remain the same (for example, the angle $\gamma$ may remain greater than 90°). Alternatively, the angle $\gamma$ of the web and flange joint may be altered. The reformed Z-shape pile 32 can be used to form a pile wall comprising a number of engagement sections or "socket" 60 (see FIGS. 5*b*, 12 and 13). The wall may be formed of combinations of reformed Z-shape piles 32 and unmodified Z-shape piles 31 or may be formed solely of reformed Z-shape piles 32.

Figure 5B:
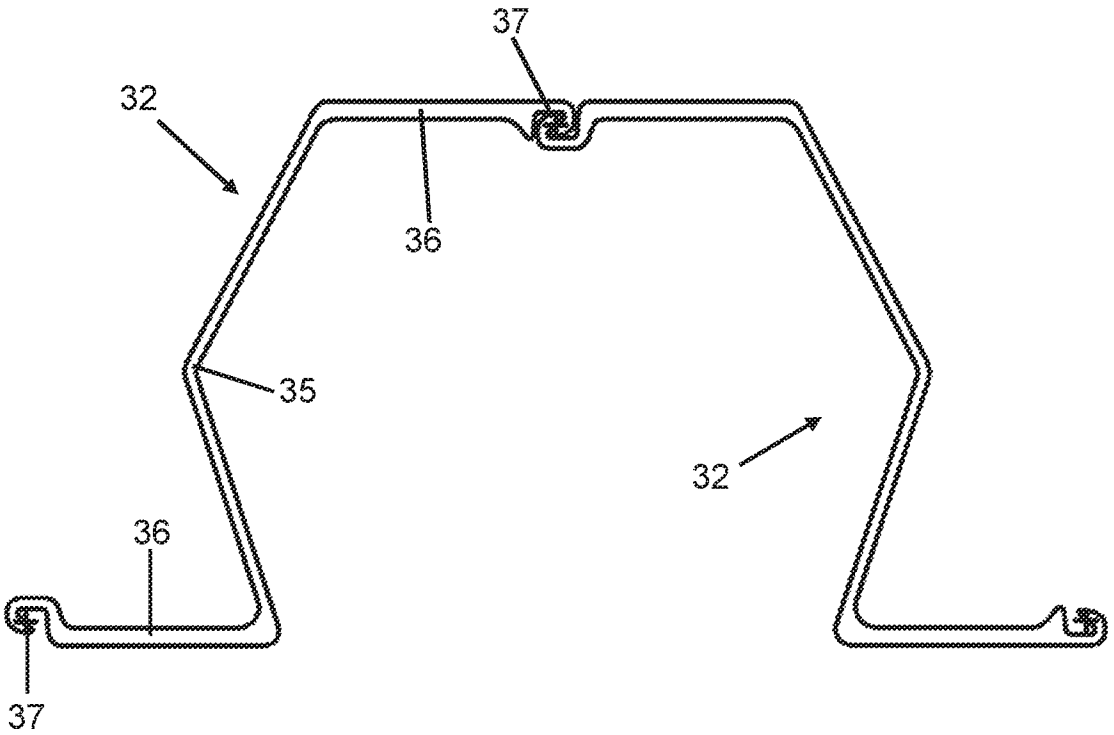
FIG. 5*b* shows, in a cross section, a double pile of two Z-shaped piles according to an embodiment of the present invention.

In this embodiment, the engagement sections 60 (or socket) are formed by at least part of the enclosure formed by the two Z-shape piles 32 having a width I at least one point greater than the width of the opening of the enclosure $I_1$ (in other words, the opening defined by the joint between the web and the flange that extends outwardly away from the enclosure). More generally, an engagement section is defined by at least part of the enclosure formed by either a reformed Z-shape pile or a reformed U-shape pile having a width wider than that of a forward portion of the enclosure formed by the pile (by forward it is meant towards the opening of the enclosure). For example, if the webs of a U-shape pile are bent inwardly (i.e. towards one another), the opening of the enclosure may remain wider than the point at which the webs are bent inwardly. However, there will be a rearward (i.e. the direction towards the flange) point at which the enclosure is wider than the distance between the two inwardly bent portions and thus the reformed pile will always have an engagement section. It will be appreciated that the engagement section 60 can function in a similar fashion to the dove-tail shape 50. The engagement section 60 can be used as part of a tongue and groove (or lock and key) connection and thus facilitates the compounding of the pile wall with other materials. The Z-shape piles 31 of FIG. 5*a* and the reformed Z-shape piles of 32 of FIG. 5*b* are joined by an interlock 37.

Figure 6A:
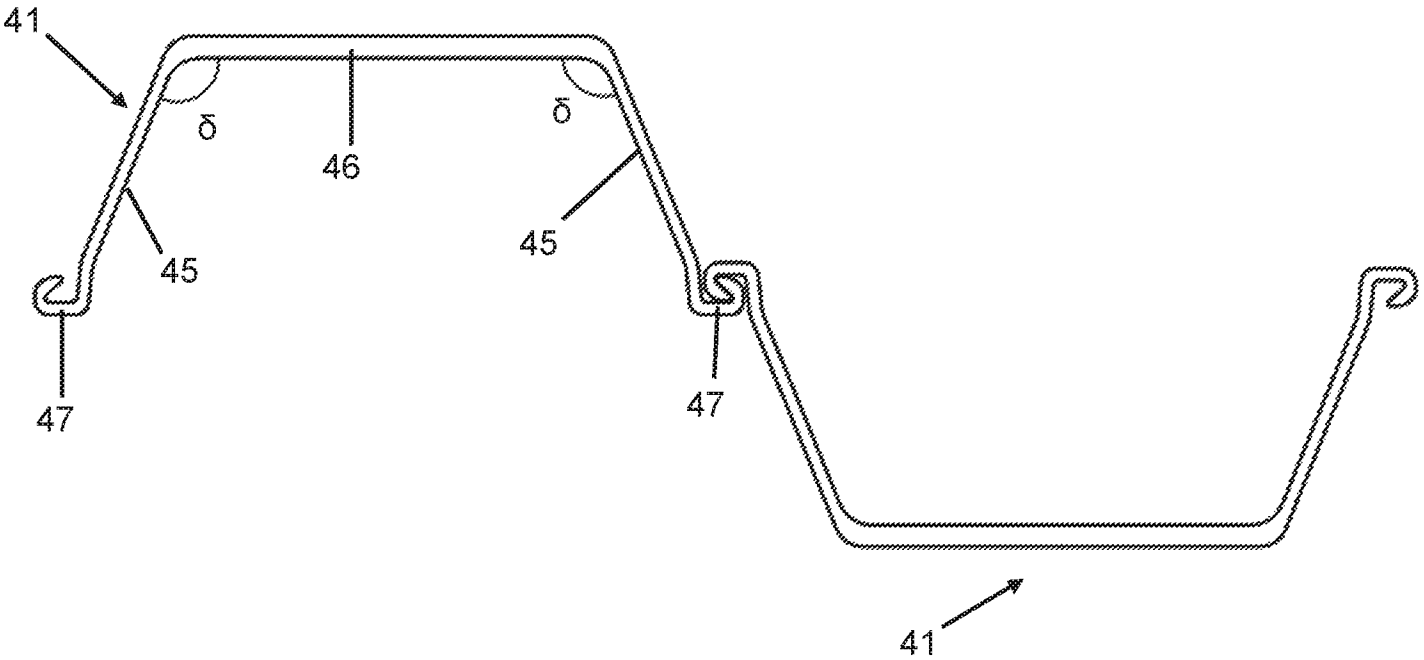
FIG. 6*a* shows, in a cross section, a double pile of two U-shaped piles prior to reforming.
Figure 6B:
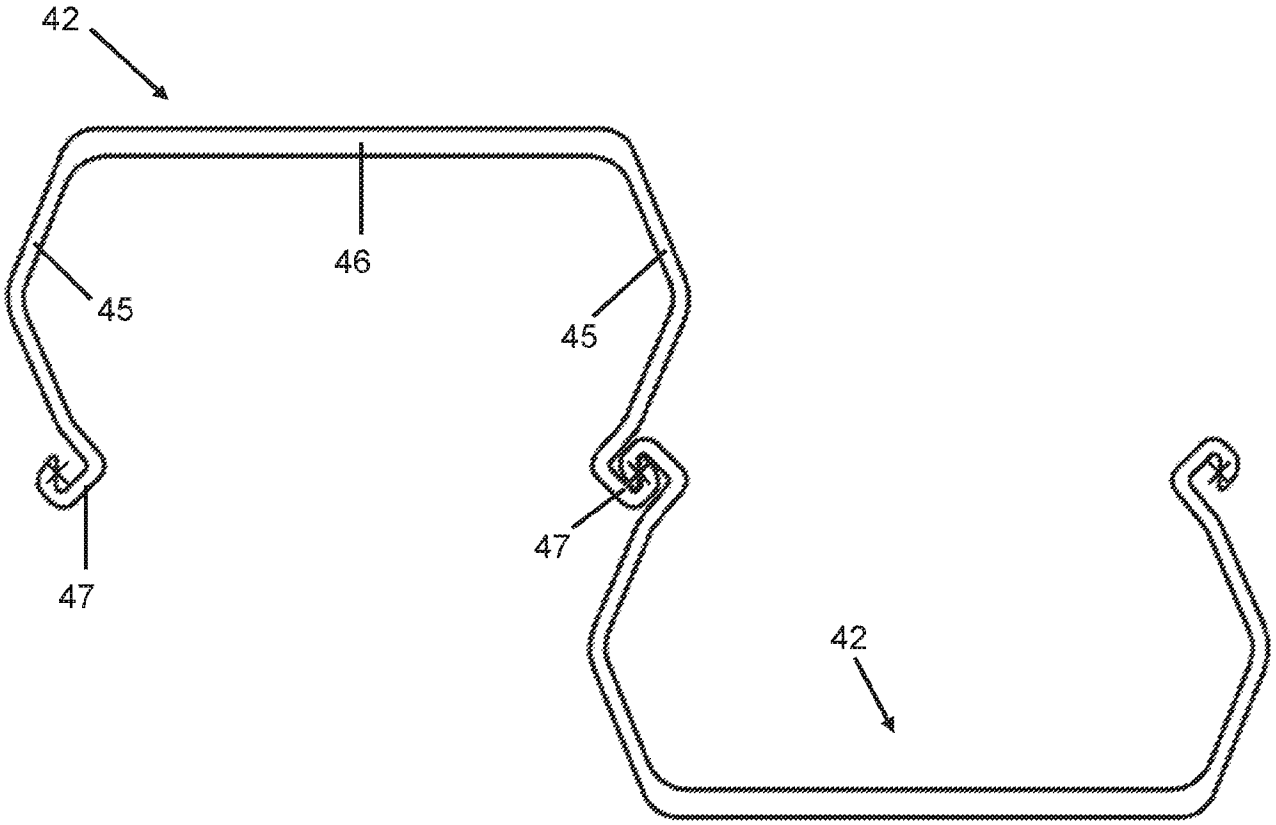
FIG. 6*b* shows, in a cross section, a double pile of two U-shaped piles according to an embodiment of the present invention.

In another embodiment of the invention, a U-shape pile 41, having two webs 4S and a flange 46, (see FIG. 6*a*) may be reformed (e.g. by cold reforming) so as to bend at least a portion of at least one of the webs 4S. At least one of the webs 4S of the U-shape pile 41 may be bent in either direction and at any point. This results in a reformed U-shape pile 42 (see FIG. 6*b*) having a web 4S that extends away from a linear vector drawn between the joint at which the reformed web 4S meets the flange 46 and the opposite end of the reformed web 4S, as indicated by the hashed line 48. It will be appreciated that either one web 4S or both webs 4S of the pile 41 can be reformed, with both options resulting in a pile having the desired properties. The angle $\delta$ of the web and flange joint may remain the same (for example, the angle $\delta$ may remain greater than) 90°. Alternatively, the angle $\delta$ of the web and flange joint may be altered. By reforming at least one of the webs 4S of the U-shape pile 41, an engagement section 60 is formed. As with the dove-tail shape 50 and the engagement section 60 of the Z-shape pile 32, the U-shape pile 42 engagement section 60 facilitates the compounding of the pile wall with other materials in a tongue and groove fashion. The U-shape piles 41 of FIG. 6*a* and the reformed U-shape piles 42 of FIG. 6*b* are joined by an interlock 47.

Figure 7:
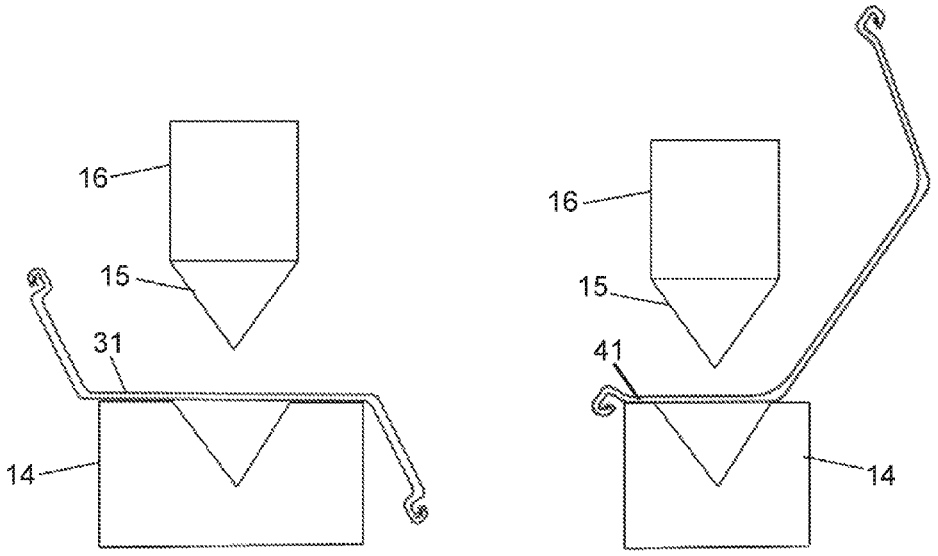
FIG. 7 shows an example of how the piles may be cold reformed so as to bend the web of the piles.

The reformed Z-shape pile 32 and U-shape pile 42 can be formed using the same techniques as outlined in FIGS. 3 and 4, with the exception that the angle is formed in the web and flange rather than at the web/flange joint. For example, FIG. 7 shows how both a Z-shape pile 31 and U-shape pile 41 could be reformed using a knife block arrangement. It will be appreciated that the method of FIG. 4 could equally be used to reform Z-shape piles 32 and U-shape piles 42 along their webs and flanges. It will also be appreciated that it will usually be easier to reform a steel pile along the web/flange than at the web/flange joint.

Typical steel piles will have a thickness between 8 mm and 18 mm and quality of the steel will typically vary between S 240 GP and S 430 GP (standards according to British Standard EN 10248-1:1996 "Hot rolled sheet piling of non alloy steels. Technical delivery conditions"), Reforming the Z-shape pile 31 or U-shape pile 41 along this length will usually require a pressing force of between 100 tonnes per meter and 300 tonnes per meter. Reforming or bending the piles does not necessarily need to be completed in a single pass or reforming action. It can be reformed by bending the sheet pile in a number of separate bending or reforming operations. For example, it is possible to bend the material incrementally both by angle of bend and length of bend per operation.

Figure 8:
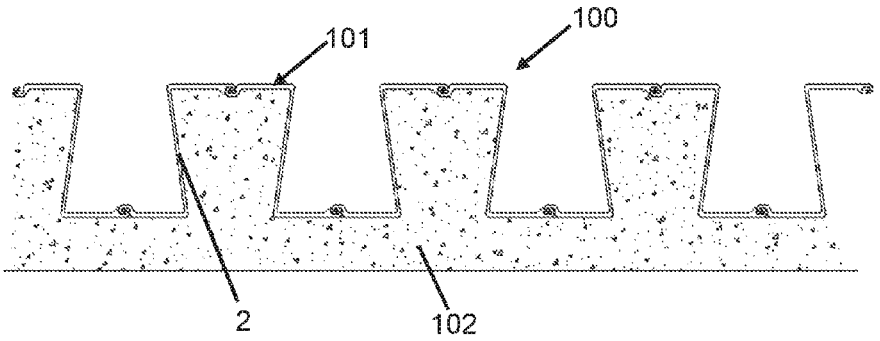
FIG. 8 shows an embodiment of the reformed piles.

FIG. 8 shows an embodiment of the invention. FIG. 8 shows a sheet pile wall 101 constructed from a plurality of cold-reformed Z-shape piles 2. It will be appreciated that the wall could equally be constructed from reformed U-shape piles 22. The Z-shape piles 2 are arranged such that the wall 101 has a repeating fish-tail shape, or dove-tail shape. This allows a concrete wall 102 to be cast against the sheet pile wall 101, thereby forming a composite sheet pile and concrete wall 100. The composite wall of FIG. 8 provides additional strength and waterproofing, as well as a defence against corrosion. In addition, the concrete may provide a finished surface for the wall. The fish-tail shape of the wall 101 provides an anchor for the concrete wall 102 to engage with, thereby preventing lateral movement of the concrete wall 102. This eliminates the need for multiple shear connectors, which would be required when using traditional steel piling. In some embodiments, soffit shuttering (not shown) may be required to retain the concrete and prevent it from exuding from the engagement section. An example soffit shutter may be attached to the bottom of the side shutter and be hinged like a pair of scissors. To install and engage the soffit shutter, the scissor components would be inserted into the pile in a retracted arrangement and, once in position, expanded. In the expanded arrangement, the scissor components engage the sheet pile to the extent that they can resist liquid concrete pressures. In addition, in the expanding position, the soffit seals the dovetail aperture in a cross section, which prevents concrete seeping out of the base of the engagement section. The soffit may move from a retracted arrangement to an expanded arrangement by actuation by a hydraulic cylinder or other mechanical means. Removal after the setting of the concrete would be the reverse of the installation procedure (i.e. the soffit would be moved from an expanded arrangement to a retracted arrangement). The soffit may be attached by securing means at the upper end of the sheet pile wall or may be attached via a tie rod, which passes over the top of the piles and attaches to securing means on the opposite side of the pile wall.

Figure 9:
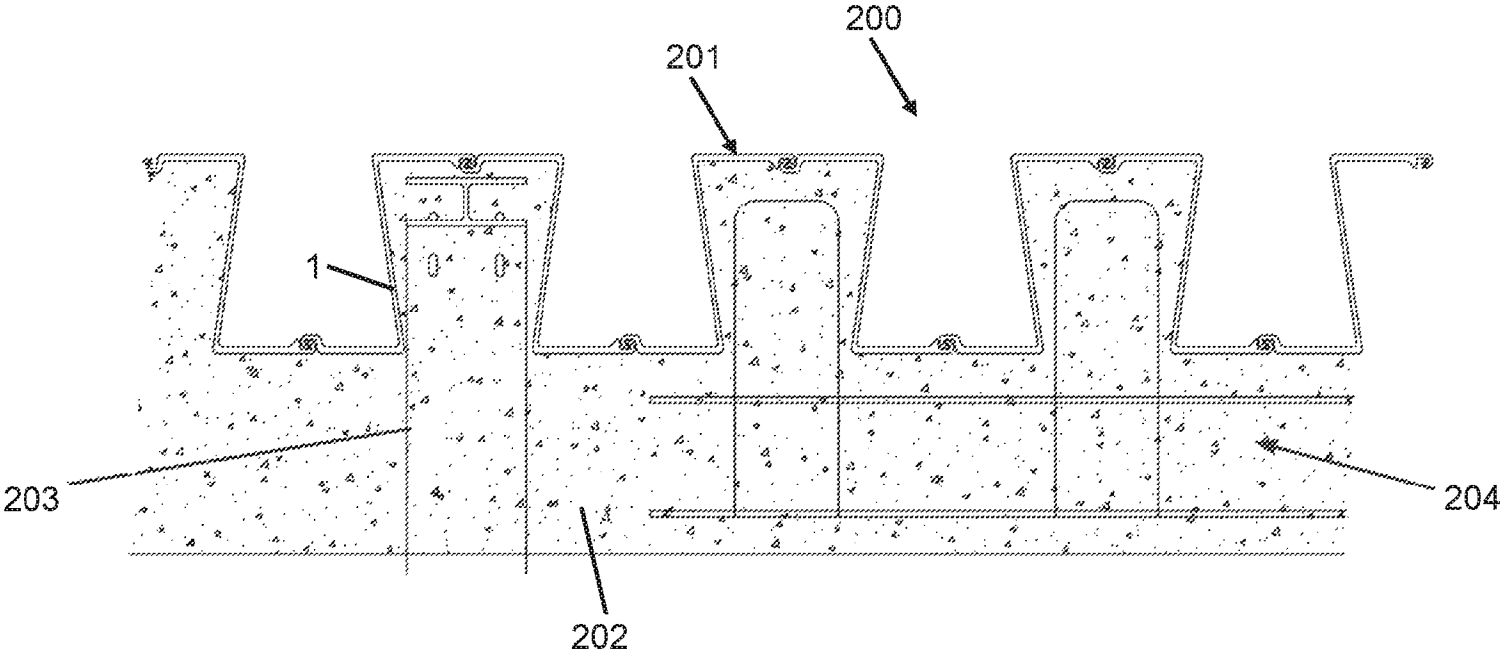
FIGS. 9 to 14 show additional embodiments of the reformed piles.

FIG. 9 shows a further embodiment of the invention, wherein a composite wall 200 having a sheet pile wall 201 and a concrete fill forming a concrete wall 202, constructed as described in FIG. 8, is reinforced with an anchor pile 203. The anchor pile 203 will provide anchorage and support for the wall 200, increasing the strength of the wall 200.

As previously discussed, FIG. 10 shows a further embodiment of the invention, wherein a wall 301 constructed from a plurality of cold-reformed Z-shape piles 2 is arranged such that the wall 301 has a repeating dove-tail or tongue and groove, shape 50 with a concrete wall 303. This allows shaped panels of rubber 302 to engage the dove-tail shape 50 for anchorage. The shaped panels of rubber 302 can form a watertight seal, which prevents corrosion or erosion of the piles 2. In particular, the seal can prevent accelerated low water corrosion. The shaped panels of rubber 302 can be added after the construction of the wall 301 and may be formed from waste re-constituted car tyres. In an embodiment, the wall may 301 may be reinforced by a concrete layer 304, which can be strengthened by further anchorage 304.

Figure 11:
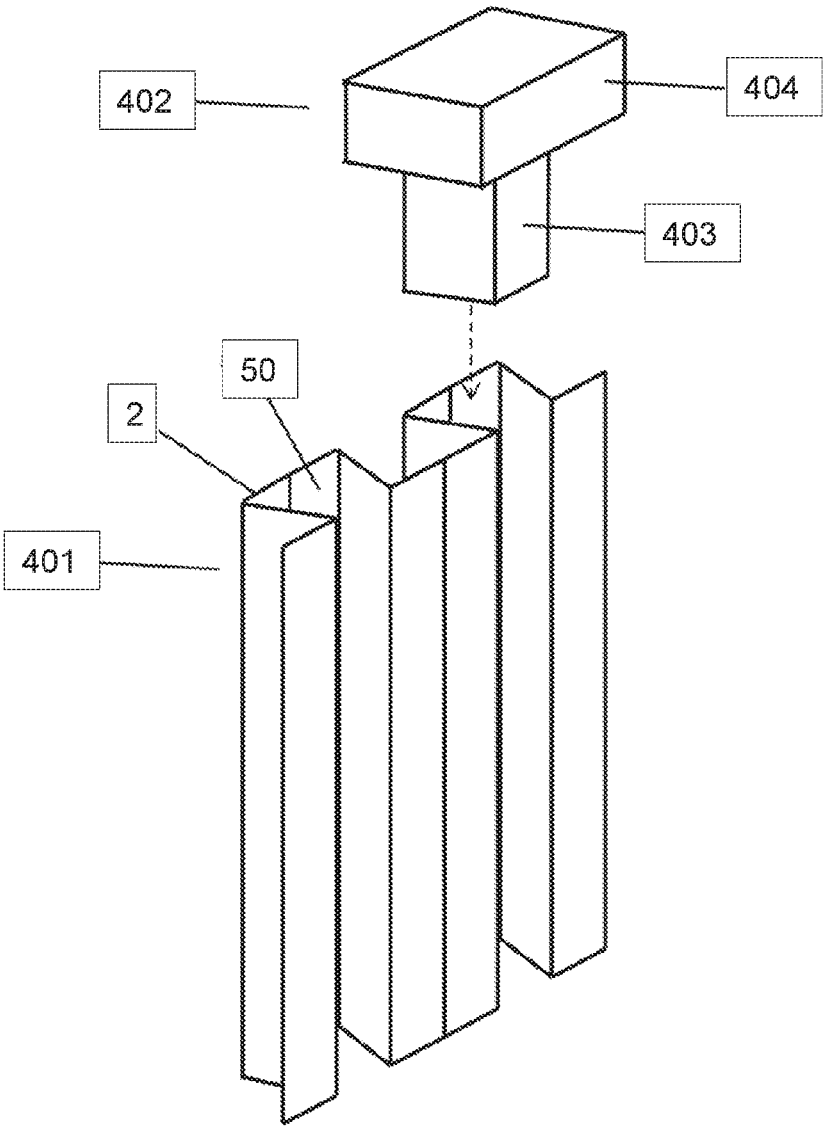

FIG. 11 shows a further embodiment of the invention, wherein a wall 401 constructed from a plurality of cold-reformed Z-shape piles 2 is arranged such that the wall 401 has a repeating dove-tail, or tongue and groove, shape 50. This shape allows pre-formed concrete caps 402, having an elongate peg 403 and a head 404, to be inserted into the top of the wall 401. The elongate peg 403 of the cap 402 is shaped to engage the dove-tail shape 50 created by two of the cold-reformed Z-shape piles 2 (or one cold-reformed U-shape pile 22) and is inserted into dove-tail shape 50, with the head 404 of the cap 402 capping the top of the wall 401. The dove-tail shape 50 provides a secure, engaging base for the cap 402 to anchor into and thus enables the caps 402 to be adequately secured to the wall 401 without further fittings. Each cap 402 can cover a pair of reformed Z-shape piles 2 or a single reformed U-shape pile 22. The head 404 of the cap 402 can be used for any number of applications, including as a foundation for further structures or as a protective cover. The head 404 of the cap 402 may have an interlocking mechanism whereby one cap 402 can be interlocked with an adjoining cap 402. The use of reformed Z-shape 2 and U-shape piles 22 that form a dove-tail shape 50 is particularly advantageous as it allows the concrete caps 402 to be pre-fabricated prior to construction. Current methods tend to rely on casting concrete on site, which is a time consuming and laborious process. Thus, the invention allows for a faster and cheaper construction process. It will be appreciated that the caps 402 can be used in conjunction with any of the embodiments of FIGS. 9 to 13. Furthermore, the skilled person would appreciate that the caps 402 could be formed of any suitable material. In addition to the pre-cast concrete cap 402, it will be appreciated that other types of pre-cast concrete engaging member (not shown) could be employed. For example, a pre-cast concrete member that provides a corrosion barrier may also be engaged with a wall 401. In this embodiment, the pre-cast concrete member may have a similar shape to that of the shaped rubber panels 302.

Figure 12:
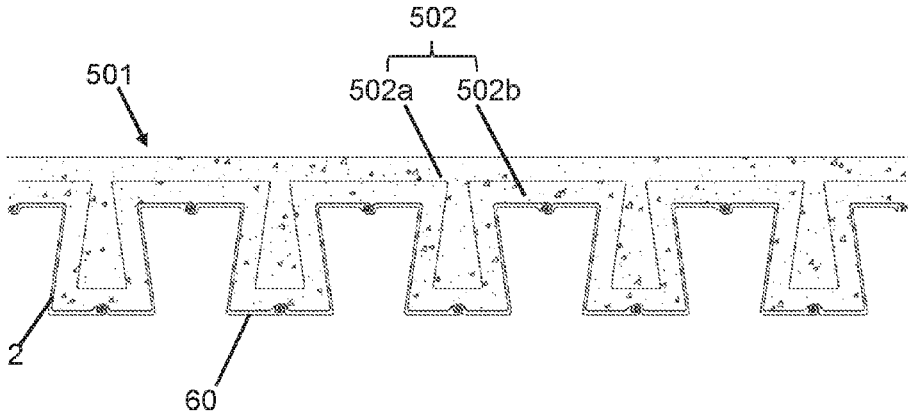

FIG. 12 shows an embodiment of the invention wherein a Z-shape pile 2 that has been reformed is used to form a wall 501. The wall 501 has a number of engagement portions 60 which provide anchorage points for additional components. For example, the wall 501 can be used in a port or as part of a bridge pier. A pile retaining wall used in an environment with flowing water may require additional properties such as a smooth face for hydraulic flow and abrasion and corrosion resistance. In addition, there is typically a requirement for the walls to have an acceptable appearance. This can be achieved in the wall 501 using the engagement portion 60, which enables the use of either pre-cast (not shown) or set in-situ concrete infill 502 (here two layers are shown—502*a* and 502*b*). The concrete 502 is anchored into the engagement section 60 of the piling thus reducing the requirement for further anchorage such as raking or bolts. Once set, the concrete has a smooth surface and an aesthetically pleasing finish. Moreover, as a result of the interlocking structure formed (i.e. the concrete 502 being anchored in the engagement section 60), the composite wall 501 (i.e. the piling and the concrete) has a high vertical load bearing capacity with a high lateral stiffness but while still maintaining a higher flexibility than would be achieved with concrete alone. The wall 501 has the properties of a high modulus wall while maintaining a slender section (more so than a sheet piling wall formed from unmodified (i.e. un-reformed) sheet piling), which is also important for reducing impedance of water flow. The engagement portions 60 also provide an anchorage point for additional components in parts that are not coated in concrete, such as fenders for preventing damage to the wall. The invention in this embodiment enables the quick construction of a strong, functional wall that can be added to and further improved in a modular fashion.

Figure 13:
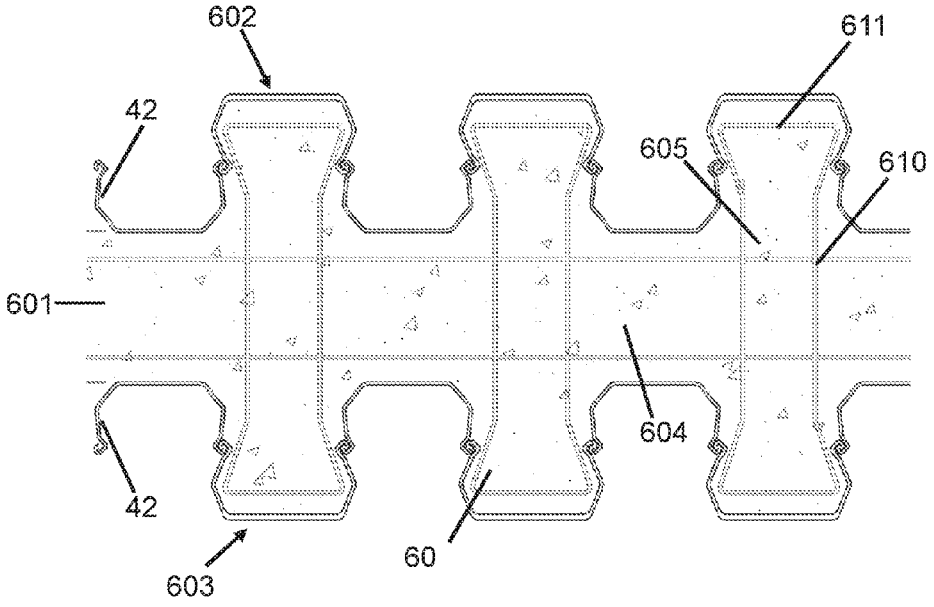

FIG. 13 shows another embodiment of the present invention. The composite wall 601 is comprised of two separate sheet piling walls. Each of these walls 602, 603 is formed of a row of reformed U-shape piles 42, with alternating orientations (outwardly and inwardly facing with respect to a centre line running through the wall). The flanges of the U-shape piles 42 have been reformed such that each U-shape pile 42 forms a single engagement section 60. In this embodiment, the piles are aligned such that an inwardly facing pile is opposite another inwardly facing pile. However, in alternative embodiments the piles can be aligned in any orientation. In another embodiment, the inwardly facing piles and the outwardly facing piles may be of different steel thickness. For example, the outwardly facing flanges (i.e. the orientation wherein the flange is the foremost portion of the pile) may be constructed from thicker steel (e.g. have a thicker steel flange) and the inwardly facing piles may have a thinner steel flange. This would be a more efficient use of steel and would ensure that the thicker steel is at the extreme point of the wall where it is required, but steel is not wasted on the inner face of the wall.

A hollow 604 defined by the two separate piling walls 602, 603 is strengthened by supporting steel cages 610, the cages 610 having a dove-tail shaped portion 611 (for example) to engage the engaging section 610 of the sheet piling walls 602, 603, and is filled with concrete 605. This creates a "beam effect". The exposed outer face of the wall 602 can also be concrete clad, the concrete being anchored into the outwardly facing engagement sections, which provides protection for the steel piling and further strengthens the wall 601.

The composite wall 601 of FIG. 13 has significantly improved strength when compared to a similar wall using traditional U-shape piling (i.e. using piling that has not been reformed). This arises from a combination of effects. Firstly, the interlocking of the concrete and the piling (in the engagement section 60) increased the rigidity and strength of the structure 601. Secondly, the modulus of the steel piling wall is increased. In alternative embodiments, using reformed Z-shape and U-shape piles 2, 22, this effect is particularly large as there is a significant increase in modulus per unit of wall resulting from the increased number of high modulus piles in the wall.

In alternative embodiments, the gap 604 formed between the two separate piling walls 602, 603 can be altered based on the requirements of the wall 601. In one embodiment, the area 604 between the two piling walls 602, 603 may not be excavated. In alternative embodiments, the gap or void 604 can be filled by any suitable material (e.g. concrete). Excavation of the material between the two piling walls 602, 603 can be carried out using a hydraulically actuated grab mounted on a column and operated by the piling rig. Partial excavation of any material located in the engagement section 60 of the piling can be achieved using an auger mounted on the piling rig. Alternatively or in conjunction with the augering process, a spoon shaped to fit the engagement sections 60 is mounted on the leading edge of a column. When inserted into the engagement sections 60, the column is driven down which forces the material out of the engagement section and into the void formed between the two sheet piling walls 602, 603. If necessary, the material spoils can then be removed from the void 604 between the two piling walls 602, 603. It will also be appreciated that a similar mechanism can be used with a wall formed from a single sheet piling wall and/or with a wall having a dove-tail shape 50.

In the construction of the composite wall 601, the structural integrity of the wall 601 can be improved by ensuring that the vertical shear forces present in the steel piles are fully transferred to the concrete 605 by forming indentations on the sheet piling, Accordingly, when the void 604 between the piling walls 602, 603 is filled with concrete 605, the concrete 605 will also fill the indentations and form an interference fit; thus facilitating shear transfer. The indentations can be formed by lowering a column having a plurality of horizontally mounted hydraulic cylinders into the engagement section 60 of the piling walls 602, 603. The cylinders would preferably have a hard steel point and, when actuated, the hard steel points form an indentation in the wall of the each of the pilings. This can be repeated to form multiple indentations.

Figure 14:
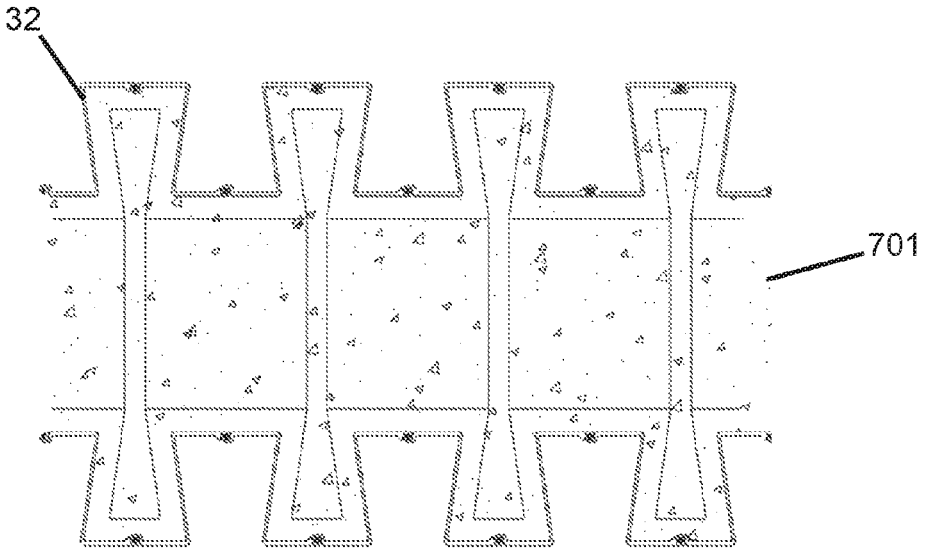

In another embodiment, a composite wall 701 may be formed of reformed Z-shape piles 32, as shown in FIG. 14. It will be appreciated that the composite wall 702 has similar properties and the same benefits as the composite wall 601 of FIG. 13.

In a further embodiment, the composite walls 601, 701 of FIGS. 13 and 14, for example, may be in a staggered configuration. For example, the top of steel pile wall 602 may be at a first height (e.g. at ground level) and the top of the steel pile wall 603 may be at a second height (e.g. lower than the first height). It will be appreciated that if the steel pile walls 602 and 603 are formed of substantially identical piles then the bottom of steel pile wall 603 will also be lower than the bottom of wall 602. Accordingly, a cross-section of the composite wall 601 in this embodiment would show a thinner wall section at both the top and bottom sections of the composite wall, where the wall is defined by only one of the steel pile walls 602, 603. This provides an additional advantage in that steel wastage is reduced compared to a typical high modulus retaining wall, where the same steel section is used across the whole height of the wall. The practice of using the same steel section across the whole height can often be a waste of steel as a thick steel section is not required at the head (top) or toe (bottom) of the pile, where the bending moment (and therefore force exerted against the wall) is smaller than in the middle section. However, since in the staggered configuration the composite wall 601 only has a higher modulus in the middle section (e.g. where the force exerted on the wall is highest), the piles used in the wall can be shorter and therefore the amount of steel used can be reduced.

The steel piles 2, 22, 32, 42 of the present invention have a particular advantage over existing retaining walls, in particular "Combi" retaining walls, in that the reformed piles 2, 22, 32, 42 can be driven using environmentally friendly equipment such as hydraulic pressing tolls. In contrast, the "Combi" retaining walls require large equipment such as hammers and vibrators, which restricts the environments in which "Combi" walls can be installed. Thus, the piles of the present invention 2, 22, 32, 42 enables the construction of walls in environments where existing walls would either have been weaker than desired (due to the limitations of the construction techniques) or the construction of the wall would be disruptive to the surrounding environment. Furthermore, as walls constructed using the piling of the present invention can easily be concrete clad or protected by rubber inserts (for example), the walls require significantly less maintenance than existing high modulus walls, particularly "Combi" walls, which due to their shape cannot be concrete clad.

The walls also advantageously can also be constructed significantly faster than existing sheet piling walls by virtue of the engagement sections 60 and dove-tail shape 50. These engaging means 50, 60 enable pre-cast and pre-fabricated objects to be connected to the walls, which reduces construction time and time spent on-site. The engagement means 50, 60 also reduces the amount of bolting, welding and other securing processes that would usually be required to secure composite walls and other objects to the walls (e.g. fenders). This also reduces the costs involved in construction of the walls.

In another embodiment, curved walls or circular walls may be built using the sheet piles of the present invention (e.g. the piling may be reformed such that when the pile is driven so as to form a wall, the wall is curved or forms a full circle). In this embodiment, unlike typical high modulus walls which must be driven in straight lines, the curved wall retains a high modulus. In this embodiment, the dove-tail shape 50 (or engagement section 60) of the inner radius wall preferably corresponds (i.e. matches) that of the dove-tail shape 50 (or engagement section 60) of the outer radius wall. This may require varying the angle used to bend or re-work the sheet pile so that the width of each of the inner radius wall sheet piles is reduced to a smaller arc, for example to a width wherein any radius drawn from the centre of the circle defined by the inner radius wall that intercepts the interlock of the inner radius wall sheet piling, also intercepts the interlock of the corresponding outer radius wall sheet piling. In one embodiment, the sheet piling of the inner radius wall may be thinner than that of the sheet piling of the outer radius wall.

With regard to FIGS. 9 to 14, it will be appreciated that all of the embodiments could equally be constructed from any of the other reformed piles of the present invention. For example, with regard to FIGS. 9 to 12 a U-shape pile 22 reformed by reducing the web/flange angle or the Z-shape piles 32 and U-shape piles 42 reformed by bending at a point along their webs 35, 45 would be equally suitable. These embodiments would have the same advantages as discussed above.

It will be appreciated additional, alternative, methods of reforming the Z-shape 1,31 or U-shape 21,41 piles of FIGS. 1*a*, 2*a*, 5*a* and 6*a* may be employed. In one embodiment, for example, the piles may be reformed to form the reformed Z-shape 2, 32 and reformed U-shape 22, 42 piles of FIGS. 1*b*, 2*b*, 5*b* and 6*b* by means of a first and second set of steel section rollers. In particular, the piles can first be rolled from a steel section in a steel mill to form the Z-shape 1,31 or U-shape 21,41 piles of FIGS. 1*a*, 2*a*, 5*a* and 6*a* using conventional techniques. Then, either while still hot or after cooling, the piles 1,21,31,41 may be put through a second set of rollers having a different diameter than the first, to produce the reformed Z-shape 2, 32 and reformed U-shape 22, 42 piles of FIGS. 1*b*, 2*b*, 5*b* and 6*b*. In an alternative embodiment, this may be achieved by reheating cooled Z-shape 1,31 or U-shape 21,41 piles and shaping them using a second set of rollers having a different diameter to the first. It will also be appreciated that these embodiments may be part of a single, continuous process.

Other variations to the disclosed embodiments can be understood and effected by those skilled in the art in practicing the claimed invention, from a study of the drawings, the disclosure, and the appended claims. For example, in the examples above:

The sheet piling may be of any thickness. For example, the sheet piling may be 5 mm thick, 10 mm thick, 15 mm thick, 20 mm thick or 30 mm thick;

The interlock of the sheet piling may be any means for connecting two sheet piles together; and The reforming of the steel piling by bending the pile along the web (Z-shape) or the flange (U-shape) may be repeated so as to form a plurality of bends in the web or flange.

The invention claimed is:

1. A method of forming a sheet pile wall, comprising:

taking a plurality of Z-shape piles or U-shape piles, the Z-shape pile comprising two flanges and a web with an angle between the web and each of the flanges of the Z-shape pile being greater than 90° and the U-shape pile comprising two webs and a flange with an angle between each of the webs and the flange of the U-shape pile being greater than 90°;

cold reforming the Z-shape piles to decrease the angle between the web and flanges of the Z-shape pile to less than 90° or cold reforming the U-shape piles to the decrease the angle between the webs and the flange to less than 90° thereby forming reformed steel piles; and connecting a plurality of the reformed steel piles so as to form the sheet pile wall having at least one engagement section, the engagement section when viewed in a cross section being a recess that has a narrowed neck portion.

2. The method of claim 1, wherein the Z-shape or U-shape pile is reformed to decrease the angle to less than 80° but greater than 30°.

3. The method of claim 1, wherein the engagement section is an anchorage point for connection of additional materials or components, in particular the engagement section has a dove-tail shape.

4. The method of claim 1, further comprising engaging one of a rubber insert, a preformed concrete facing panel and cap, a steel cage or in-situ cast concrete with the engagement section of the sheet pile wall.

5. The method of claim 1, wherein at least two sheet pile walls are arranged as a composite wall.

6. The method of claim 5, wherein the two sheet pile walls of the composite wall have a gap therebetween, the gap being filled with concrete.

7. The method of claim 1, wherein connecting a plurality of reformed steel piles comprises driving a reformed pile into a surface such that it joins to an adjacent pile via an interlock mechanism.

8. The method of claim 7 further comprising excavating material located within the engagement sections of the wall after driving the pile into the surface.

9. The method of claim 1, wherein the Z-shape pile or the U-shape pile is formed by hot rolling a steel section.

10. A method of forming a sheet pile wall, comprising:

taking a plurality of Z-shape piles or U-shape piles, the Z-shape pile comprising two flanges, each flange having a first end and a second end, and a web having a first end and a second end and the U-shape pile comprising two webs, each web having a first end and a second end, and a flange having a first end and a second end;

cold reforming the Z-shape piles such that at least a portion of the web extends away from a linear vector extending from the first end to the second end of the web or cold reforming the U-shape piles such that at least a portion of the flange extends away from a linear vector extending from the first end to the second end of the flange thereby forming reformed steel piles; and connecting a plurality of the reformed steel piles so as to form the sheet pile wall having at least one engagement section, the engagement section when viewed in a cross section being a recess that has a narrowed neck portion.

11. The method of claim 10, wherein the Z-shape or U-shape pile is reformed to decrease the angle to less than 80° but greater than 30°.

12. The method of claim 10, wherein the engagement section is an anchorage point for connection of additional materials or components, in particular the engagement section has a dove-tail shape.

13. The method of claim 10, further comprising engaging one of a rubber insert, a preformed concrete facing panel and cap, a steel cage or in-situ cast concrete with the engagement section of the sheet pile wall.

14. The method of claim 10, wherein at least two sheet pile walls are arranged as a composite wall.

15. The method of claim 14, wherein the two sheet pile walls of the composite wall have a gap therebetween, the gap being filled with concrete.

16. The method of claim 10, wherein connecting a plurality of reformed steel piles comprises driving a reformed pile into a surface such that it joins to an adjacent pile via an interlock mechanism.

17. The method of claim 16, further comprising excavating material located within the engagement sections of the wall after driving the pile into the surface.

18. The method of claim 10, wherein the Z-shape pile or the U-shape pile is formed by hot rolling a steel section.

* * * * *